US007594781B1

(12) United States Patent
Sanders

(10) Patent No.: US 7,594,781 B1
(45) Date of Patent: Sep. 29, 2009

(54) LIFT BOAT LEG

(76) Inventor: Ronald Sanders, P.O. Box 2363, Boerne, TX (US) 78006

( * ) Notice: Subject to any disclaimer, the term of this patent is extended or adjusted under 35 U.S.C. 154(b) by 0 days.

(21) Appl. No.: 12/129,094

(22) Filed: May 29, 2008

Related U.S. Application Data

(60) Provisional application No. 60/941,429, filed on Jun. 1, 2007.

(51) Int. Cl.
*E02B 17/08* (2006.01)

(52) U.S. Cl. ..... 405/198; 405/196

(58) Field of Classification Search ..... 405/195.1, 405/196, 197, 198, 199, 200
See application file for complete search history.

(56) References Cited

U.S. PATENT DOCUMENTS

| | | | | | |
|---|---|---|---|---|---|
| 2,308,743 | A | | 1/1943 | Bulkley et al. | |
| 2,877,629 | A | * | 3/1959 | De Long et al. | 405/198 |
| 2,920,870 | A | * | 1/1960 | Suderow | 405/196 |
| 3,183,676 | A | | 5/1965 | Tourneau | |
| 3,195,313 | A | * | 7/1965 | Swatek, Jr. | 405/196 |
| 3,290,007 | A | | 12/1966 | Yeilding | |
| 3,332,663 | A | * | 7/1967 | Cargile, Jr. | 405/198 |
| 3,367,119 | A | | 2/1968 | Rybicki | |
| 3,606,251 | A | | 9/1971 | Willke et al. | |
| 3,750,210 | A | | 8/1973 | Barnard et al. | |
| 3,945,450 | A | | 3/1976 | Wilson et al. | |
| 3,967,457 | A | | 7/1976 | Lovie | |
| 4,156,577 | A | * | 5/1979 | McMakin | 405/196 |
| 4,161,376 | A | * | 7/1979 | Armstong | 405/196 |
| 4,417,664 | A | | 11/1983 | Gordon | |
| 4,445,805 | A | * | 5/1984 | Ray et al. | 405/196 |
| 4,456,404 | A | | 6/1984 | Evans | |
| 4,482,272 | A | | 11/1984 | Colin | |
| 4,505,615 | A | * | 3/1985 | Evans | 405/196 |
| 4,505,616 | A | | 3/1985 | Grzelka et al. | |
| 4,589,799 | A | | 5/1986 | Hotta et al. | |
| 4,627,768 | A | | 12/1986 | Thomas et al. | |
| 4,678,165 | A | | 7/1987 | Eloranta | |
| 4,722,640 | A | | 2/1988 | LeTourneau | |
| 4,813,814 | A | | 3/1989 | Shibuta et al. | |
| 5,139,366 | A | | 8/1992 | Choate et al. | |
| 5,188,484 | A | * | 2/1993 | White | 405/198 |
| 5,580,189 | A | | 12/1996 | Sanders et al. | |
| 5,607,259 | A | * | 3/1997 | Thomas et al. | 405/198 |
| 5,797,703 | A | | 8/1998 | Delamatyr | |
| 5,954,454 | A | * | 9/1999 | Bennett | 405/199 |
| 6,099,207 | A | * | 8/2000 | Bennett | 405/199 |
| 6,718,903 | B1 | * | 4/2004 | Moise et al. | 405/196 |
| 7,258,510 | B2 | * | 8/2007 | Kawasaki | 405/198 |
| 2002/0197113 | A1 | * | 12/2002 | Legleux | 405/196 |

* cited by examiner

*Primary Examiner*—Frederick L Lagman
(74) *Attorney, Agent, or Firm*—Garvey, Smith, Hehrbass & North, L.L.C.; Charles C. Garvey, Jr.

(57) ABSTRACT

An improved jack up vessel includes a hull, a plurality of legs, each leg having a pad, and a jacking mechanism for moving the hull upward and downward. Each leg is a generally triangular leg that is a closed wall, buoyant structure.

19 Claims, 4 Drawing Sheets

LIFT BOAT LEG

CROSS-REFERENCE TO RELATED APPLICATIONS

Priority of U.S. Provisional Patent Application Ser. No. 60/941,429, filed Jun. 1, 2007, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND

The present invention relates to lift boats or jack-up boats that feature a hull having a plurality of legs, each leg having an associated jacking mechanism that enables the hull to be elevated or lowered relative to the legs and wherein each leg has a load bearing pad that engages the seabed during use. More particularly, the present invention relates to an improved lift boat having an improved leg configuration that contributes buoyance by providing a specially shaped and watertight leg that has one or more racks that engage pinion gear(s) of a drive or jacking unit.

Lift boats are well known in the art. These devices are also referred to as jack up barges or jack up boats. Such vessels include a floating hull that allows the vessel to travel on a body of water. When the vessel reaches a selected locale, jacking units lower the legs and then elevate the barge or hull above the water surface so that the hull is not affected by substantial wave action.

Patents have issued for lift boats or jack up vessels. Possibly relevant examples (each incorporated herein by reference) can be found in the following table.

| U.S. Pat. No. | Title | Issue Date |
|---|---|---|
| 2,308,743 | Barge | Sep. 16, 1939 |
| 3,183,676 | Mobile Sea Platform | Oct. 20, 1960 |
| 3,290,007 | Jack Arrangement For A Platform Structure | Jun. 28, 1965 |
| 3,367,119 | Flotation Device for Offshore Platform Assembly | Jan. 20, 1966 |
| 3,606,251 | Leg Supported Offshore Structure With Jacking Apparatus | Nov. 14, 1969 |
| 3,750,210 | Apparatus For The Construction Of Bridges | Aug. 7, 1973 |
| 3,945,450 | Apparatus and Method For Rendering An Offshore Drilling Platform Mobile | Mar. 23, 1976 |
| 3,967,457 | Self-elevating Offshore Drilling Unit Legs | Jul. 6, 1976 |
| 4,417,664 | Method and Apparatus For Mounting Lift Crane On Offshore Structures | Nov. 29, 1983 |
| 4,456,404 | Method and Apparatus For Positioning A Working Barge Above A Sea Surface | Jun. 26, 1984 |
| 4,482,272 | Load Transfer And Monitoring System For Use With Jackup Barges | Nov. 13, 1984 |
| 4,505,616 | Self-locking Chock System For A Jack-up Rig Unit | Mar. 19, 1985 |
| 4,589,799 | Device For Locking Platform Of Offshore Structure | May 20, 1986 |
| 4,627,768 | Locking Device For Oil Platforms | Dec. 9, 1986 |

-continued

| U.S. Pat. No. | Title | Issue Date |
|---|---|---|
| 4,678,165 | Mode Of Construction Of Lifting Mechanisms For Jack-up Platform And Lifting Mechanism For a Jack-up Platform | Jul. 7, 1987 |
| 4,722,640 | Slant Leg Offshore Platform And Method Of Operating Same | Feb. 2, 1988 |
| 4,813,814 | Leg-holding Device For Offshore Platform | Mar. 21, 1989 |
| 5,139,366 | Offshore Jackup Rig Locking Apparatus And Method | Aug. 18, 1992 |
| 5,580,189 | Jack-up Rig Crane | Dec. 3, 1996 |
| 5,797,703 | Elevating Unit For Use With Jack-up Rig | Aug. 25, 1998 |

Some of these patented rigs/vessels employ an open truss or lattice type leg. For example, see U.S. Pat. No. 3,183,676 issued to R. G. Letourneau which shows an open truss or lattice type leg structure for a jack-up or lift boat.

BRIEF SUMMARY OF THE PRESENT INVENTION

In one embodiment, the present invention provides an improved jack up vessel that includes a hull, a plurality of legs (preferably three), a plurality of pads, one pad attached to each leg, and a jacking mechanism for moving each leg upward and downward. Each leg is a triangular, non open truss leg having a generally continuous outer wall or walls that envelop an interior buoyant cavity. Each such buoyant cavity contributes buoyancy to the vessel.

There are multiple advantages of this triangular non open truss leg arrangement. Vortex shedding is eliminated or minimized. Harmonic Rhythmic movement is eliminated or minimized. Provides a transitional leg design between a traditional columnar lift boat leg design and a triangular/lattice legs, i.e., leg lengths of about 260' and greater. Provides buoyancy to reduce bottom bearing pressure unlike truss/lattice legs that provide no buoyancy. Such truss/lattice legs increase bottom bearing pressure due to their weight.

BRIEF DESCRIPTION OF THE SEVERAL VIEWS OF THE DRAWINGS

For a further understanding of the nature, objects, and advantages of the present invention, reference should be made to the following detailed description, read in conjunction with the following drawings, wherein like reference numerals denote like elements and wherein.

DETAILED DESCRIPTION OF THE INVENTION

Figure 1:
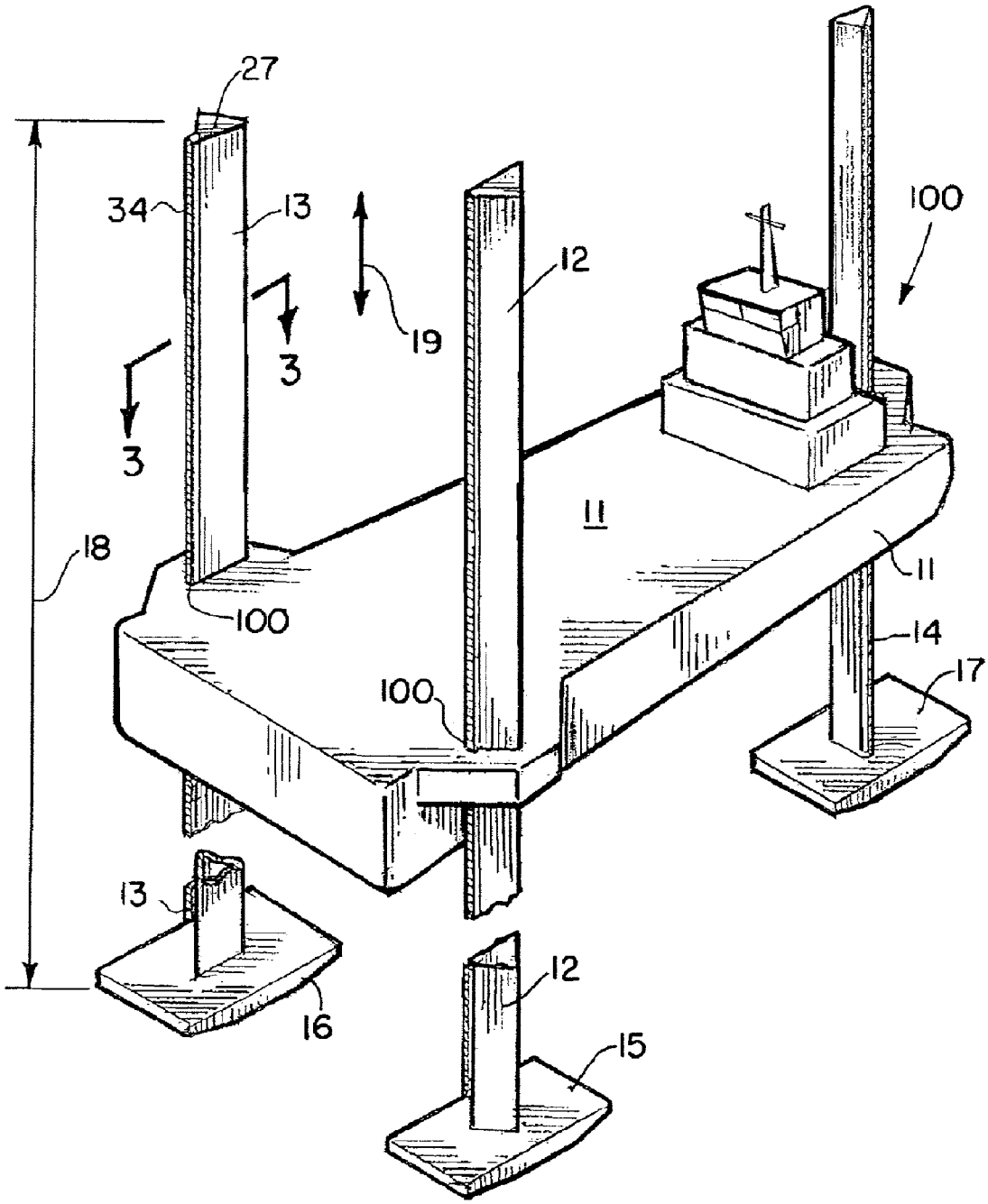
FIG. 1 is a perspective view of one preferred embodiment of the apparatus of the present invention.

FIG. 1 shows the preferred embodiment of the apparatus of the present invention, designated generally by the numeral 10. Lift boat or jack up vessel 10 has a hull 11 and a plurality of legs (e.g., three legs 12, 13, and 14). Leg 12 can include pad or foot 15. Leg 13 can include pad or foot 16. Leg 14 can include pad or foot 15. Each leg 12, 13, 14 is preferably a closed wall, watertight member. Each leg 12, 12, 14 preferably has a generally triangular transverse cross section, such as those shown in FIGS. 3-10. Further, each leg 12, 13, 14 is preferably of a closed wall, non-lattice or non-truss construction. Each leg 12, 13, 14 can be of welded steel construction, for example.

In one embodiment a cross section comprises three sides which can be triangular in shape. In one embodiment at least one lifting portion is included which includes a lifting rack. In one embodiment a plurality of lifting portions are included, each including a lifting rack. In one embodiment each lifting rack includes a plurality of lifting threads.

Figure 3:
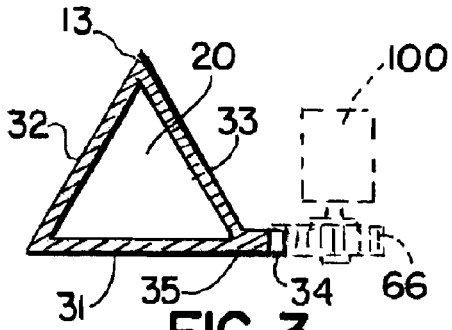
FIG. 3 is a fragmentary view taken along lines 3-3 of FIG. 1, illustrating the preferred embodiment of the apparatus of the present invention.

FIG. 3 shows one example of a closed wall construction (i.e. non-lattice or non open truss) for legs 12, 13, 14 with cross section 20, It comprises side 31, side 32, and side 33. In FIG. 3, lifting portion 35 can include a lifting rack 34 that is substantially parallel to side 31. Such a rack 34 is engaged by a lifting unit or jacking unit 100 that provides one or more pinion gears 66.

Figure 4:
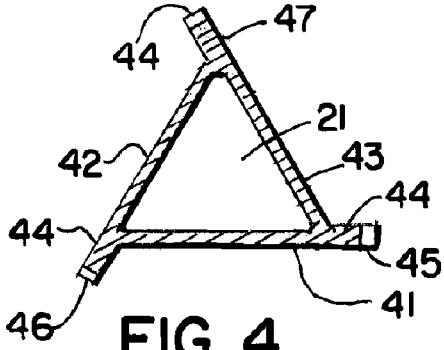
FIG. 4 is a fragmentary view of an alternative embodiment of the apparatus of the present invention.

FIG. 4 shows another example of a non-truss construction for a leg having cross section 21. It comprises side 41, side 42, and side 43. Lifting portion 45 can include a lifting rack 44 that is substantially parallel to side 41. Lifting portion 46 can include a lifting rack 44 that is substantially parallel to side 42. Lifting portion 47 can include a lifting rack 44 that is substantially parallel to side 43.

Figure 5:
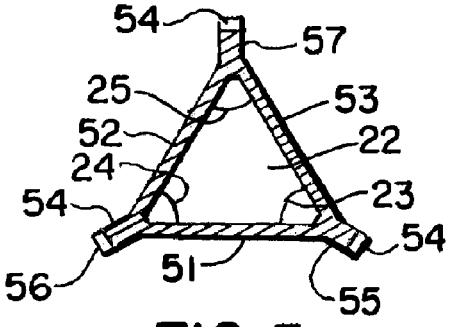
FIG. 5 is a fragmentary view of another alternative embodiment of the apparatus of the present invention.

FIG. 5 shows another example of a non-truss construction for a leg having cross section 22. It comprises side 51, side 52, and side 53. Angles 23, 24, and 25 are shown. Lifting portion 55 can include a lifting rack 54 and intersect the angle made by sides 51 and 53 (angle 23). Preferably, it substantially bisects the angle created by sides 51 and 53. Lifting portion 56 can include a lifting rack 54 and intersect the angle 24 made by sides 51 and 52. Preferably, it substantially bisects the angle created by sides 51 and 52 (angle 24). Lifting portion 57 can include a lifting rack 54 and intersect the angle made by sides 52 and 53 (angle 25). Preferably, it substantially bisects the angle created by sides 52 and 53 (angle 25).

Figure 6:
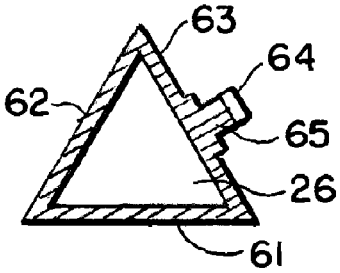
FIG. 6 is a fragmentary view of another alternative embodiment of the apparatus of the present invention.
Figure 7:
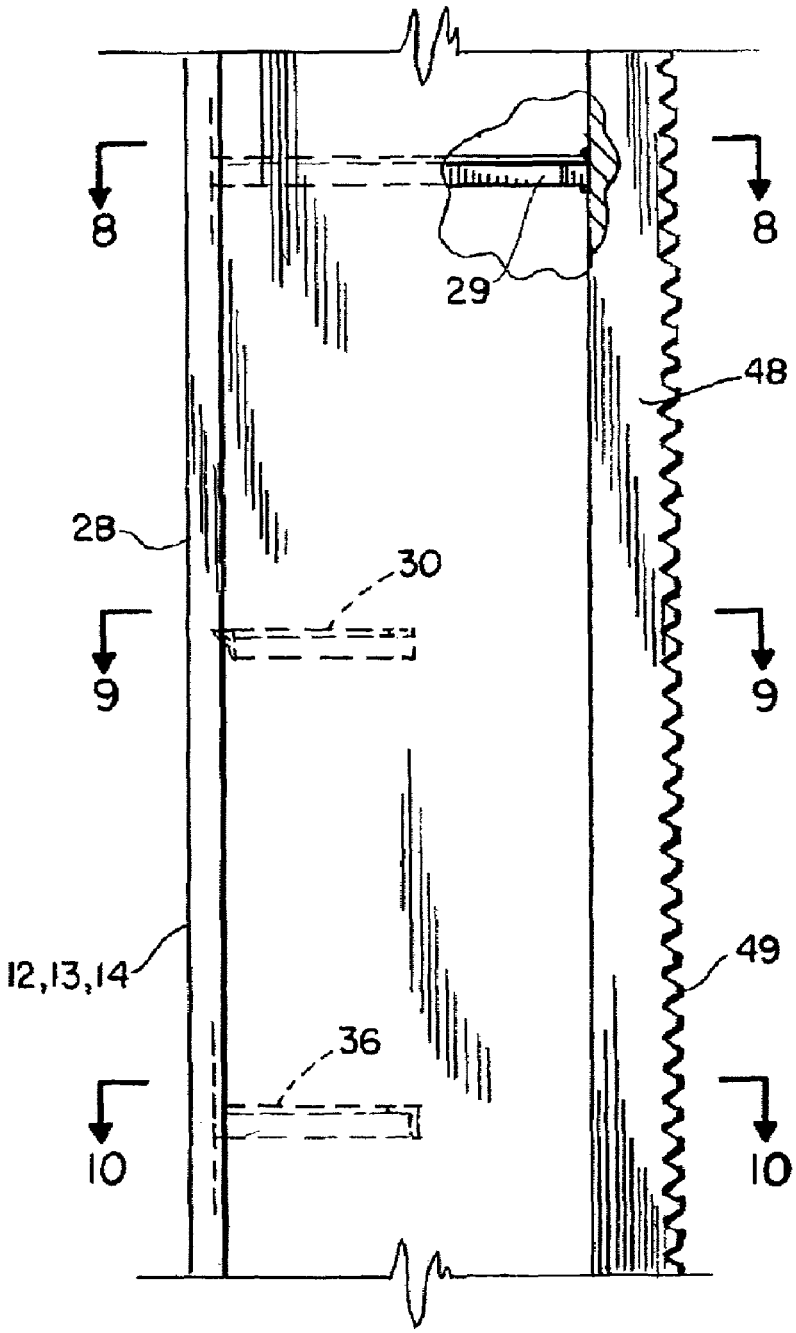
FIG. 7 is a partial sectional elevation view of the preferred embodiment of the apparatus of the present invention.

FIG. 6 shows another example of a non-truss construction for a leg having cross section 26. It comprises side 61, side 62, and side 63. Lifting portion 65 can include a lifting rack 64 and be substantially perpendicular to any side, such as side 63 and substantially bisect such side (e.g. 63) as shown.

Legs 12, 13, and 14 protrude through hull 11. Each leg 12, 13, 14 interfaces with a jacking portion 100 to facilitate the upward or downward movement of hull 11 upon the legs 12, 13, 14. Each leg 12, 13, and 14 can have one or more jacking portions 100. Upward and downward movement is schematically indicated by arrows 19 in FIG. 1.

For example, jacking mechanism 100 moves hull 11 along leg 13 in either an upward or downward motion as is required. Jacking portion 100 moves along the length 18 of lifting portion 35 by virtue of a lifting rack 34 which includes a plurality of teeth that engage the teeth of a pinion gear 66 of mechanism 100.

As a result of the leg cross sectional shapes 20, 21, 22, 26 and closed wall construction (FIGS. 3-6), the problem of vortex shedding is minimized and possibly eliminated. Further, the problem of harmonic rhythmic movement is minimized and possibly eliminated.

In one embodiment each leg 12, 13, 14 can provide a buoyancy of about 5, 10, 15, 20, 25, 30, and 35 percent of the overall weight of the vessel. In other embodiments the buoyancy provided by each leg 12, 13, 14 can range between any to of the above specified percentages (5-35%).

In one embodiment each leg 12, 13, 14 can be 10, 20, 30, 40, 50, 60, 70, 80, 90, 100, 125, 150, 175, 200, 250, 300, 350, 400 feet or longer. In other embodiments the length of each leg 12, 13, 14 can range between any two of the above specified lengths.

In one embodiment each leg can have a cross section of 1, 2, 3, 4, 5, 6, 7, 8, 9, 10, 15, 20, 25, 30, 35, 40, 45, 50, 60, 70, 80, 90, 100, 110, 120, 130, 140, 150, 175, 200, 225, or 250 square feet or larger. In other embodiments the cross sectional area of each leg can range between any two of the above specified areas.

Figure 2:
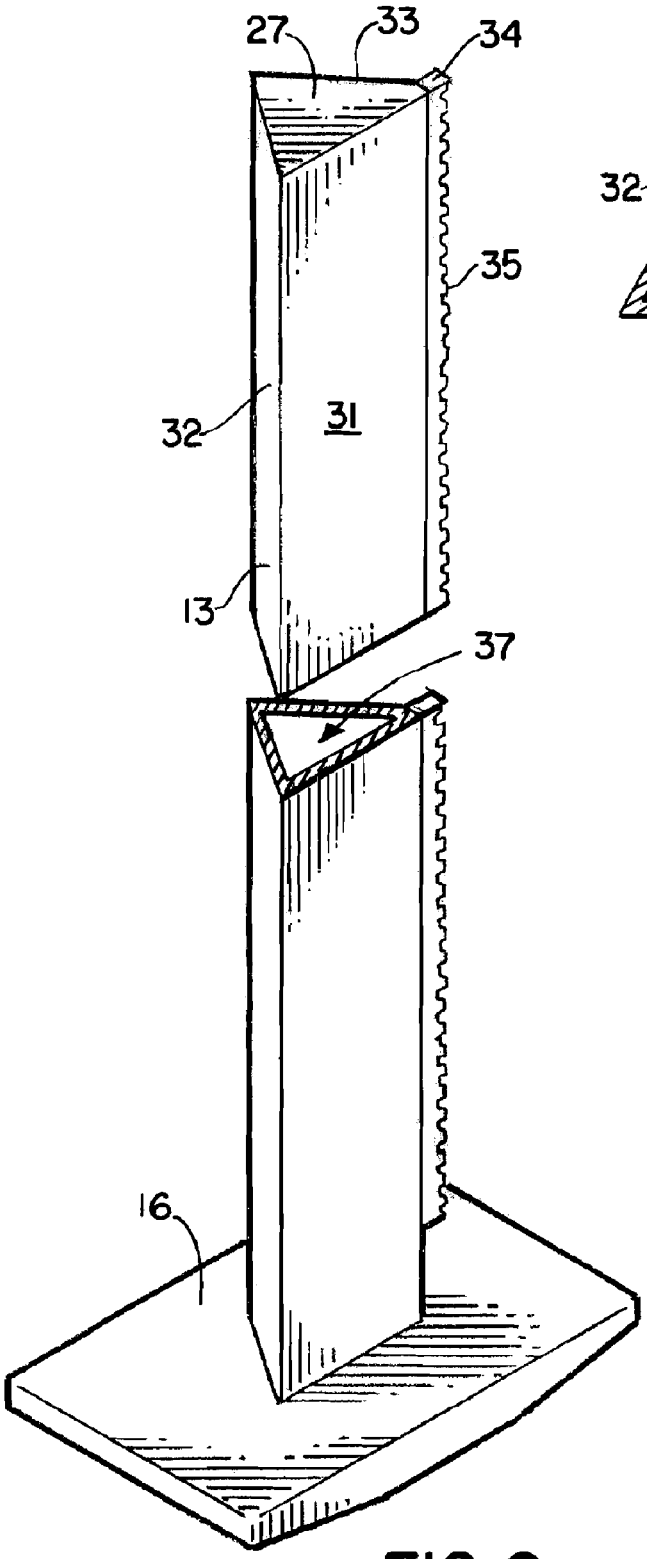
FIG. 2 is a top plan view of one preferred embodiment of the apparatus of the present invention.

Each of the legs 12, 13, 14 shown in FIGS. 1-6 is a closed wall buoyant structure. The sidewalls such as the walls 31, 32, 33 in FIG. 3 provide a closed wall buoyant structure in combination with an upper or top wall 27 and a welded, sealed arrangement that connects the bottom of each leg 12, 13, 14 to its foot or pad 15, 16, 17. Each of the legs shown in FIGS. 4, 5, 6 would likewise provide an upper or top wall 27 and a sealed connection of its foot to the lower end portion of the leg 12, 13, 14 as shown in FIG. 2.

Figure 8:
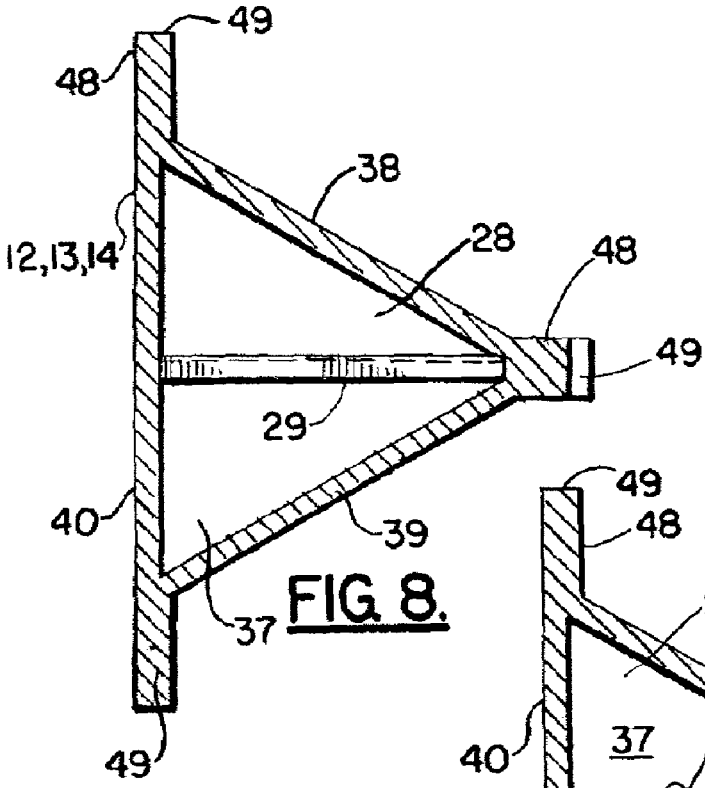
FIG. 8 is a sectional view taken along lines 8-8 of FIG. 7.

FIGS. 7-10 show that each leg 12, 13, 14 can have a shape or cross section 28 defined by walls 38, 39, 40 to provide a closed wall buoyant chamber 37. As with the embodiment of FIGS. 1-6, the legs 12, 13, 14 shown in FIGS. 7-10 can provide a lifting portion and a lifting rack. In FIG. 8, the lifting portion 48 provides lifting rack 49 that forms an angle with each of the sides 38, 39, preferably an obtuse angle. The side 40 is co-linear with two lifting portions 48, each having its own lifting rack 49 as shown.

Figure 9:
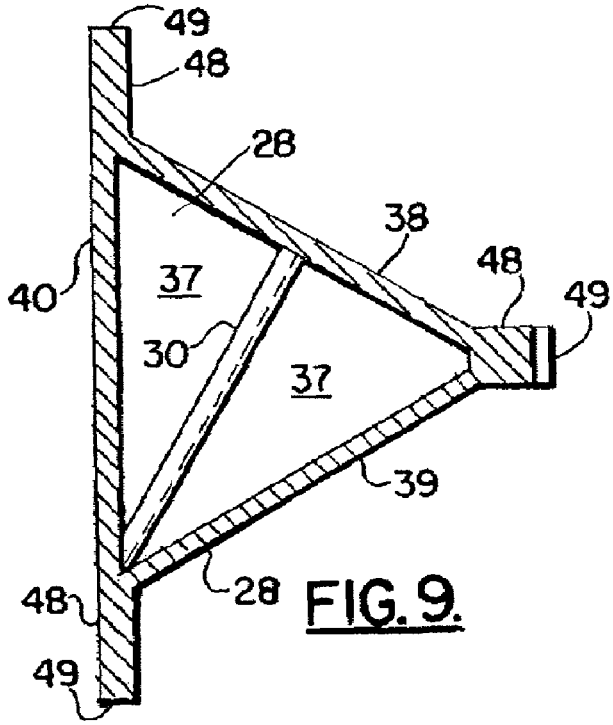
FIG. 9 is a sectional view taken along lines 9-9 of FIG. 7.
Figure 10:
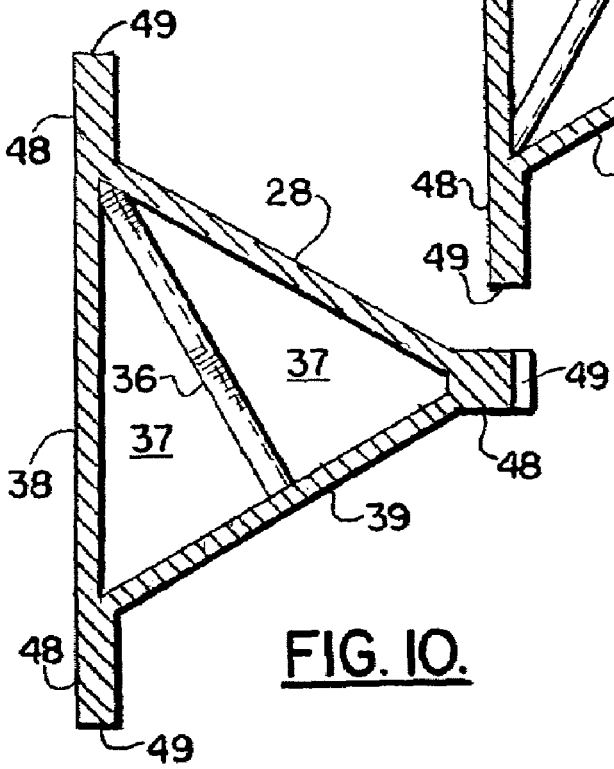
FIG. 10 is a sectional view taken along lines 10-10 of FIG. 7.

FIG. 8 illustrates that internal bracing can be employed for the leg 12, 13, 14 such as the internal brace 29 that extends perpendicularly from and which bisects the leg 40. In FIG. 9, internal brace 30 is a diagonally extending brace that bisects the side 38 and that extends perpendicularly therefrom. The internal brace 36 in FIG. 10 bisects the side 39 and extends perpendicularly therefrom. Such braces 29, 30, 26 can be of welded steel construction, for example.

The following is a list of suitable parts and materials for the various elements of the preferred embodiment of the present invention:

PARTS LIST

| Reference Numeral | Description |
|---|---|
| 10 | jack up vessel |
| 11 | hull |
| 12 | leg |
| 13 | leg |
| 14 | leg |
| 15 | pad or foot |
| 16 | pad or foot |
| 17 | pad or foot |

-continued

PARTS LIST

| Reference Numeral | Description |
|---|---|
| 18 | lifting portion |
| 19 | arrow |
| 20 | cross section |
| 21 | cross section |
| 22 | cross section |
| 23 | angle |
| 24 | angle |
| 25 | angle |
| 26 | cross section |
| 27 | top wall |
| 28 | cross section |
| 29 | brace |
| 30 | brace |
| 31 | side |
| 32 | side |
| 33 | side |
| 34 | lifting rack |
| 35 | lifting portion |
| 36 | brace |
| 37 | buoyant chamber |
| 38 | side |
| 39 | side |
| 40 | side |
| 41 | side |
| 42 | side |
| 43 | side |
| 44 | lifting rack |
| 45 | lifting portion |
| 46 | lifting portion |
| 47 | lifting portion |
| 48 | lifting portion |
| 49 | rack |
| 51 | side |
| 52 | side |
| 53 | side |
| 54 | lifting rack |
| 55 | lifting portion |
| 56 | lifting portion |
| 57 | lifting portion |
| 61 | side |
| 42 | side |
| 63 | side |
| 64 | lifting rack |
| 65 | lifting portion |
| 66 | pinion gear |
| 100 | jacking unit |

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. A jack up vessel, comprising:

a) a hull;

b) a plurality of legs movably attached to the hull, each leg having a generally triangular transverse cross section and wherein each leg is not an open truss;

c) a jacking mechanism for elevating and lowering each leg relative to the hull;

d) a pad attached to each leg;

e) each leg having a buoyant closed wall structure; and f) a tooth rack extending from the closed wall structure.

2. The jack up vessel of claim 1, wherein one or more of the legs includes a plurality of internal stiffeners for providing structural support to each stiffened leg.

3. The jack up vessel of claim 1, wherein each leg is configured to reduce or eliminate vortex shedding.

4. The jack up vessel of claim 1 wherein each leg provides buoyancy to reduce bottom bearing pressure.

5. The jack up vessel of claim 4, wherein each leg provides buoyancy to reduce bottom pressure at the pad.

6. The jack up vessel of claim 4, wherein each leg provides buoyancy to reduce bottom pressure at the pad between about 100 percent and about 150 percent of the weight of the leg relative to lattice legs.

7. The jack up vessel of claim 6, wherein the lattice legs have between about 5 and about 10 percent of buoyancy.

8. The jack up vessel of claim 1, wherein the legs are each between about 250 and 350 feet long.

9. The jack up vessel of claim 1, wherein the legs are each greater than 350 feet long.

10. The jack up vessel of claim 1, each leg has a cross section of between about 40 and 180 square feet.

11. The jack up vessel of claim 1, each leg has a cross section of between about 43 and 173 square feet.

12. The jack up vessel of claim 1, wherein each leg has a plurality of vertices and a rack is provided at one or more of the vertices.

13. The jack up vessel of claim 1, wherein harmonic rhythmic movement is minimized.

14. A jack up vessel, comprising:

a) a hull;

b) a plurality of legs movably attached to the hull and defined by multiple sides, said sides forming a closed wall watertight buoyant structure, each leg having a generally triangular transverse cross section;

c) a jacking mechanism for elevating and lowering each leg relative to the hull;

d) a tooth rack on each leg that is positioned externally of said closed wall structure; and e) a pad attached to each leg.

15. The jack up vessel of claim 14, wherein each leg is not an open truss.

16. The jack up vessel of claim 14, wherein one or more of the legs includes a plurality of internal stiffeners within said closed wall structure for providing structural support to each stiffened leg.

17. The jack up vessel of claim 14, wherein each leg has three outer watertight walls.

18. The jack up vessel of claim 14, wherein each leg is configured to reduce or eliminate vortex shedding.

19. A jack up vessel, comprising:

a) a hull;

b) a plurality of legs movably attached to the hull, each leg having a generally triangular transverse cross section and wherein each leg has three outer watertight walls;

c) a jacking mechanism for elevating and lowering each leg relative to the hull;

d) a pad attached to each leg;

e) each leg having a buoyant closed wall structure; and f) a tooth rack extending from the closed wall structure.

* * * * *